US005182996A

United States Patent [19]

Gutgsell

[11] Patent Number: 5,182,996

[45] Date of Patent: Feb. 2, 1993

[54] PIVOTING BRACKET ASSEMBLY FOR CONNECTING TABLE TOPS

[75] Inventor: David R. Gutgsell, Jasper, Ind.

[73] Assignee: Ditto Sales, Inc, Jasper, Ind.

[21] Appl. No.: 784,760

[22] Filed: Oct. 30, 1991

[51] Int. Cl.[5] ..... A47B 57/00

[52] U.S. Cl. ..... 108/64; 108/89

[58] Field of Search ..... 108/64, 114, 65, 89; 403/98, 61, 407.1; 24/586, 684, 287; 312/111, 107.5

[56] References Cited

U.S. PATENT DOCUMENTS

| | | | |
|---|---|---|---|
| 747,683 | 12/1903 | Clark | 24/684 X |
| 1,009,902 | 11/1911 | Hanson | 108/89 |
| 1,151,781 | 8/1915 | Goddard et al. | 24/684 X |
| 1,156,460 | 10/1915 | Buddle | 108/89 |
| 1,858,857 | 5/1932 | Huntley . | |
| 1,913,966 | 6/1933 | Walter | 108/89 |
| 2,053,659 | 9/1936 | Gisser . | |
| 2,661,988 | 12/1953 | Steene et al. . | |
| 2,836,475 | 5/1958 | Sapp | 108/64 |
| 2,959,792 | 11/1960 | Haugard . | |
| 3,342,147 | 9/1967 | Shettles | 108/64 |
| 3,820,477 | 6/1974 | Griffin | 108/64 X |
| 3,915,100 | 10/1975 | Sullivan | 108/64 |
| 3,964,809 | 6/1976 | Wirbilowicz et al. . | |
| 4,290,710 | 9/1981 | Waller . | |
| 4,301,744 | 11/1981 | Walter . | |
| 4,665,836 | 5/1987 | Burr | 108/64 |
| 4,915,034 | 4/1990 | Grabe et al. | 108/65 |

FOREIGN PATENT DOCUMENTS

| | | | |
|---|---|---|---|
| 10126 | 12/1955 | Fed. Rep. of Germany | 24/684 |
| 1379657 | 3/1965 | France . | |
| 1422251 | 3/1966 | France . | |
| 618804 | 4/1949 | United Kingdom . | |

*Primary Examiner*—José V. Chen

*Attorney, Agent, or Firm*—Woodard, Emhardt, Naughton Moriarty & McNett

[57] ABSTRACT

An apparatus for interconnecting table tops and table leaves comprises a number of complementary bracket assemblies and thumbscrew fasteners mounted to juxtaposed table tops or leaves. The bracket assemblies include a bracket having a pivot end, a connection end, and a first slot defining an arcuate opening between the two ends. The bracket is pivotably connected at its pivot end to a first table top. A fastener extending through the first slot and fastened to the table top limits the degree of pivoting of the bracket between a first position in which the bracket projects beyond the edge of the first table top and a second position in which the bracket is retracted completely beneath the first table top. A second slot is defined at the connection end of the bracket for engaging one of the thumbscrew fasteners in the second table top. In one embodiment, the second slot provides for linear engagement, requiring extension of the bracket and then physical movement of the table tops together. In a second embodiment,the second slot is arcuate, permitting engagement with the thumbscrew fastener of a second table when the first and second table tops are already juxtaposed. In a third embodiment, the second slot is a closed-ended slot as a safety feature for interconnection of a table leaf between two table tops.

19 Claims, 4 Drawing Sheets

PIVOTING BRACKET ASSEMBLY FOR CONNECTING TABLE TOPS

BACKGROUND OF THE INVENTION

This invention relates to an apparatus to interconnect table tops in a variety of configurations.

Tables of various sizes and shapes are employed in diverse applications and arrangements. Frequently tables are arranged adjacent and abutting one another. Since tables may be inadvertently moved in such groupings, it is desirable to be able to interconnect abutting tables for increased stability. A table connecting apparatus that retracts out of the way underneath the table is advantageous to prevent the apparatus from projecting from the table, to accommodate arrangements where the tables are not juxtaposed.

Brackets to connect tables have been the subject of previous patents. U.S. Pat. No. 4,665,836 to Burr discloses a slotted coupling link having spaced slots that may be positioned under a table. U.S. Pat. No. 4,290,710 to Waller discloses a fastening plate having two enclosed longitudinal apertures of uniform width for permitting a continuous selection of screw locations along the length of each aperture.

In each of these prior patents, as with most such prior apparatus, the coupling link is translated linearly into its operative interconnecting position, and is likewise easily inadvertently translated out of coupling position. There is, therefore, a need for a table interconnecting apparatus that operates rotationally to decrease this risk of inadvertent disconnection of abutting tables.

SUMMARY OF THE INVENTION

A pivoting bracket for connecting tables and table leaves is described. The pivoting bracket is capable of being retracted to a first position under a first table top, and pivoted to a second position extending out from the first table top for engagement with a fastening means under a juxtaposed second table top.

In one aspect of the invention, a bracket assembly includes a pivoting bracket mounted to the underside of a first table top by first mounting means, which mounting means permits limited pivoting of the bracket. A second table top has a second mounting means located on the underside of the second table top. The second table top may be aligned with the first table top with at least one edge of each table top abutting and with the pivoting bracket and second mounting means aligned between the two table tops. In this orientation, the pivoting bracket can be engaged to the second table top by way of the second mounting means, thereby interconnecting the two tables.

In one embodiment of the invention, the bracket has a pivot end and a connection end. A first slot is defined in the bracket between the pivot end and the connection end, while a second slot is formed near the connection end. The first mounting means includes a first fastener for pivotably fastening the pivot end of the bracket to the underside of the first table top, and a second fastener extending through the first slot and fastened to the underside of the table top. The bracket is pivotable about the first fastener until either end of the first slot contacts the second fastener, thereby limiting the range of motion of the bracket.

In a first position, the second fastener contacts one end of the first slot and the bracket is disposed completely under the first table top. In a second position, the second fastener is situated at the opposite end of the first slot and the bracket extends beyond the edge of the first table top. In this second position, the second slot at the connection end of the bracket is then oriented for engagement with the second mounting means on the underside of the second table top.

In another embodiment of the invention, the second slot at the connection end of the bracket is arcuate, thereby permitting interconnection with table tops that are abutted prior to pivoting the bracket to its extended position. A closed-ended slot at the connection end of a bracket in still another embodiment provides greater security against accidental disengagement between the bracket on one table top and the mounting means on an abutting table top. This latter embodiment is particularly useful for connecting table leaves between free-standing tables.

One object of the present invention is to provide a pivoting bracket to interconnect tables and table leaves. Another object is to provide a bracket capable of being pivotably retracted completely under the table top and pivotably extended outward from under the table top for interconnection with another table.

A further object is to create a bracket for the attachment of tables of like or varied shapes. Another object of the present invention is the interconnection of tables without the removal of mounting hardware from under the table top and without the need for tools.

Other objects, and certain benefits, of the present invention will become apparent to those of ordinary skill in the art from the following written description and accompanying figures.

DESCRIPTION OF THE PREFERRED EMBODIMENTS

Figure 1:
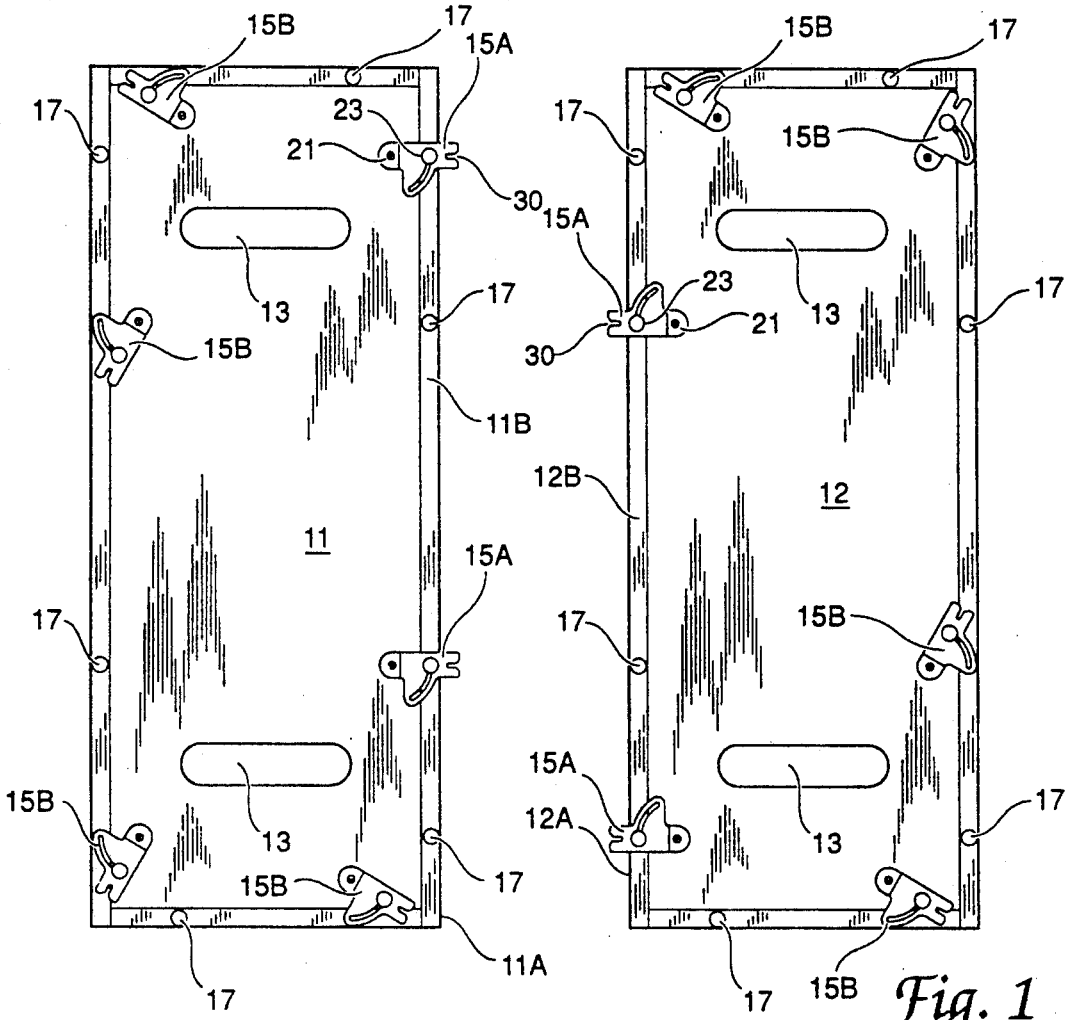
FIG. 1 is a bottom elevational view of two table tops with brackets according to one embodiment of the invention, installed on the underside of the table tops in retracted and extended positions prior to connection of the table tops aligned using the brackets.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
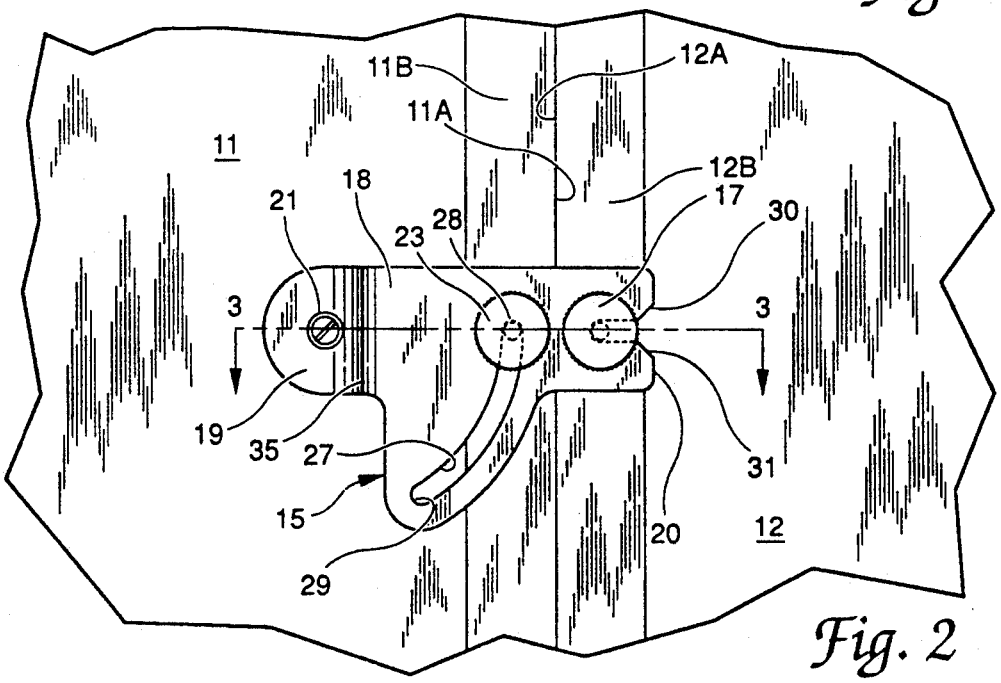
FIG. 2 is an enlarged bottom elevational view of the bracket illustrated in FIG. 1 and showing two table tops in adjacent position for connection by the bracket.
Figure 3:
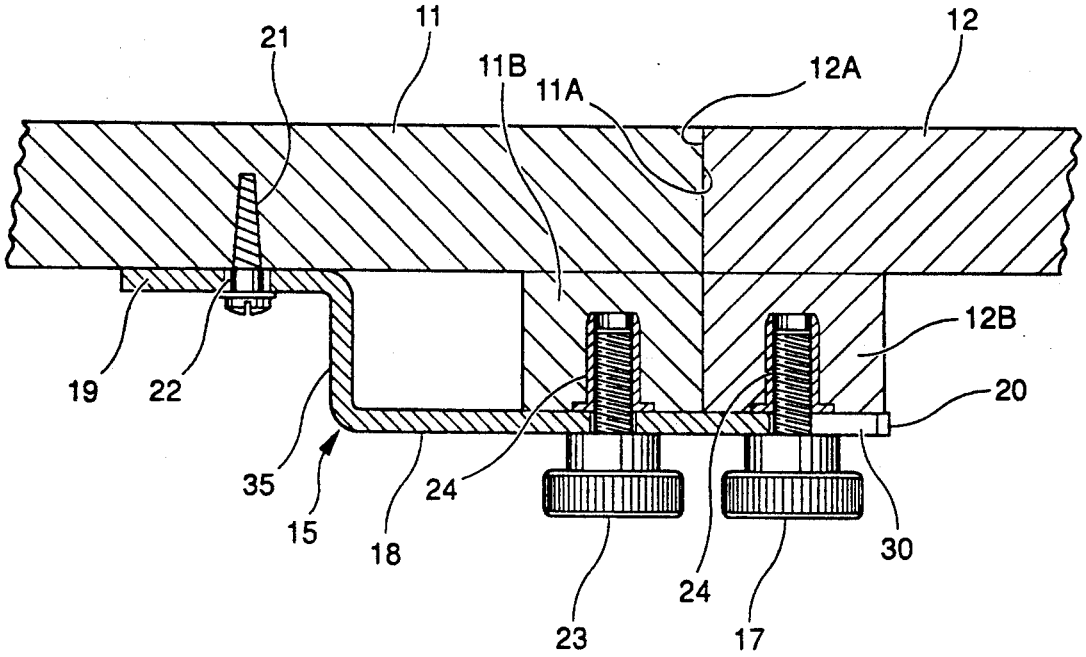
FIG. 3 is a side cross-sectional view of the bracket of FIG. 2 taken along line 2—2 as viewed in the direction of the arrows, showing a double bend in the bracket for allowing the bracket to fit table tops having a peripheral flange.

Referring first to FIGS. 1-3, one embodiment of the present invention for the connection of two or more table tops of the present invention is illustrated. FIG. 1 is a bottom view showing the underside of two rectangular table tops 11 and 12 aligned for interconnection. In this embodiment, the table tops are free-standing, each having one or more vertical legs 13 mounted to the underside of the table. The table tops are shown separated prior to being abutted and interconnected using the apparatus of the present invention.

Each of the table tops 11, 12 includes a number of pivoting bracket assemblies 15 and a corresponding number of mounting means, such as thumbscrew fasteners 17, mounted thereon in a predetermined alternating arrangement. Thus, as shown in FIG. 1, at the adjacent edges 11A and 12A of the two table tops, a bracket assembly 15 on one table is aligned with a corresponding thumbscrew 17 on the other table. This alternating arrangement of brackets and thumbscrews (or similar mounting means) is preferably repeated on a number of table tops to be interconnected.

At the abutting edges 11A and 12A of the two table tops in FIG. 1, the bracket assemblies 15A on both table tops are shown oriented in an extended position. The remainder of the bracket assemblies on each table, designated as bracket assemblies 15B, are oriented in a retracted position beneath the respective table top 11, 12. In the retracted position, the bracket assemblies are kept out of the way when not in use to avoid damage or injury.

The details of one bracket assembly 15 mounted to table top 11 are shown in FIGS. 2 and 3. The bracket assembly 15 includes a bracket 18 having a pivot end 19 and a connection end 20. The bracket 18 is connected to the first table top 11 by first mounting means which includes first and second fasteners 21 and 23, respectively. The first fastener 21 passes through an opening in pivot end 19 of the bracket 18 and is adapted to be fixed into the table top 11. The fit between the fastener 21 and bracket 18 is loose enough to permit the bracket 18 to pivot about the fastener 21. In the preferred embodiment, the fastener 21 is a screw adapted to be threaded into the table top. A bearing surface, such as bushing 22 (FIG. 3) may be interposed between the screw fastener 21 and the bracket pivot end 19.

The bracket 18 further includes a first slot 27 defining an arcuate opening between the pivot end 19 and connection end 20. The first slot 27 is a closed slot having a first end 28 and a second end 29. The second fastener 23 extends through first slot 27 and fastens to the underside of the first table top 11. In the preferred embodiment, the second fastener 23 is a thumbscrew which can be removably threaded into an insert 24 (FIG. 3) mounted in the underside of the table top. It is apparent that the second fastener 23, when fastened into insert 24, limits the range of movement of the bracket 18. More specifically, the bracket 18 can be pivoted about first fastener 21 until either end 28 or 29 of slot 27 contacts the second fastener 23. The bracket 18 can be fixed to the table top 11 by tightening the second fastener 23 down onto the bracket, thereby clamping the bracket 18 between the fastener 23 and the table top 11.

The bracket 18 further includes a second slot 30 at the connection end 20 of the bracket. In this preferred embodiment, the second slot 30 is a linear slot that opens into the bracket 18 along a line passing through the first fastener 21 and second fastener 23 when the end 28 of the slot 27 contacts the second fastener. In other words, the second slot 30 is defined in the bracket 18 so that the slot opens generally perpendicularly outward from the table edge 11A in the extended position depicted by bracket assemblies 15A (FIG. 1). In this manner, the second slot 30 can engage a mounting means thumbscrew fastener 17 in another table top, such as table top 12, by simply pushing the two table tops together. The slot 30 includes outward bevels 31 to guide the thumbscrew fastener 17 into slot 30 as the table tops are drawn together. Once the table tops 11 and 12 are juxtaposed so that the thumbscrew fastener 17 is disposed within second slot 30, the fastener 17 can be tightened down onto bracket 18 to complete the interconnection of the two table tops.

Several benefits and advantages of the present invention over prior table interconnection devices can be discerned from the foregoing description. One advantage is that the fasteners 17 and 23 need not be removed from the underside of their respective table tops (12 and 11) in order to engage the bracket 18 between the two table tops. Both fasteners 17 and 23 can be typical thumbscrews that are threaded into inserts 24 fixed within the respective table tops. The fastener 23 need only be loosened slightly to allow the fastener 23 to slide through the first slot 27 as the bracket 18 is rotated between its retracted position (15B) and its extended position (15A). Likewise, the fastener 17 can be loosened to allow the second slot 30 to slide around fastener 17 as the two table tops are pushed together. Both fasteners 17 and 23 can then be easily tightened to firmly grip the bracket 18 and hold the table tops in position. Fastener 23 can also be tightened when the bracket 18 is in the retracted position to hold the bracket under the table top.

Another advantage of the present embodiment of the invention is that the bracket 18 cannot be readily disengaged from the second table top 12 without moving the two table tops apart. This feature is accomplished by the two degrees of movement necessary to interconnect the table tops using bracket assembly 15. The first degree of freedom is rotational which brings the second slot 30 into linear alignment with the thumbscrew 17 of the juxtaposed table. The second degree of freedom is linear along the axis including the thumbscrew 17, fastener 23 and screw 21. If the two table tops are not physically moved apart, the bracket 18 cannot be rotated nor can the thumbscrew 17 be disengaged from second slot 30 (unless, of course, the thumbscrew 17 is completely removed.) Thus, even if thumbscrew 17 and fastener 23 were inadvertently loosened the bracket 18 will not slip from its engagement orientation.

The fasteners 17 and 23 in the preferred embodiment are thumbscrews having knurled heads for finger tightening of the fasteners. However, other suitable mounting fasteners can be employed, such as screws, wing nuts, internal/external threaded inserts, and pins. It is preferable, however, that the fastener be of a type that can be loosened and tightened easily by hand, without the need for tools.

In the preferred embodiment, the bracket 18 is formed from 10 gage stainless steel. The features of the bracket, including the slots 27 and 30, can be readily formed in a stamping operation. The preferred bracket is strong enough to maintain the abutted position of interconnected table tops without deformation under normal table usage.

In one specific application of the present invention, the table tops being interconnected have a peripheral flange about the underside of the table top, such as flanges 11B and 12B shown in FIGS. 1 and 3. To accommodate this flange, the bracket 18 includes a bend section 35 located near the pivot end 19, as shown in FIGS. 2 and 3. In this embodiment, the pivot end 19 of the bracket 18 is mounted to the underside of the table inboard of the flange 11B. The second portion 35 allows the bracket to negotiate the flange 11B so that the portion of the bracket carrying the first slot 27 and connection end 20 will clear the flange as the bracket 18 is pivoted.

Figure 4:
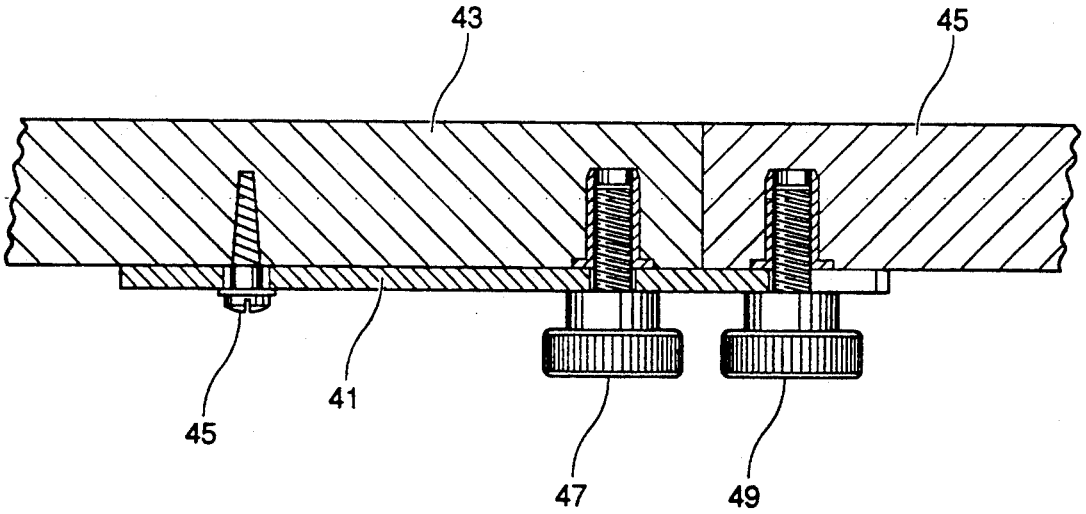
FIG. 4 is a side cross-sectional view of an alternative embodiment of the bracket of the present invention adapted for use with table tops having no peripheral flange.

Referring now to FIG. 4, in an alternative embodiment a flat bracket 41 is provided for interconnection of table tops lacking a flange or ledge on their underside, such as the table tops 43 and 45 depicted in the figure. The features of flat bracket 41 are identical to those of the bracket 18 previously described, with the exception that the bend portion 35 of the prior embodiment is not included in the alternative embodiment. The flat bracket 41 is mounted to the first table top 43 by way of a pivot screw 45 and thumbscrew fastener 47, which are identical to screw 21 and fastener 23 of the prior embodiment. Likewise, the fastener 49 threaded in the second table top 45 is identical to the previously described fastener 17.

Figure 5:
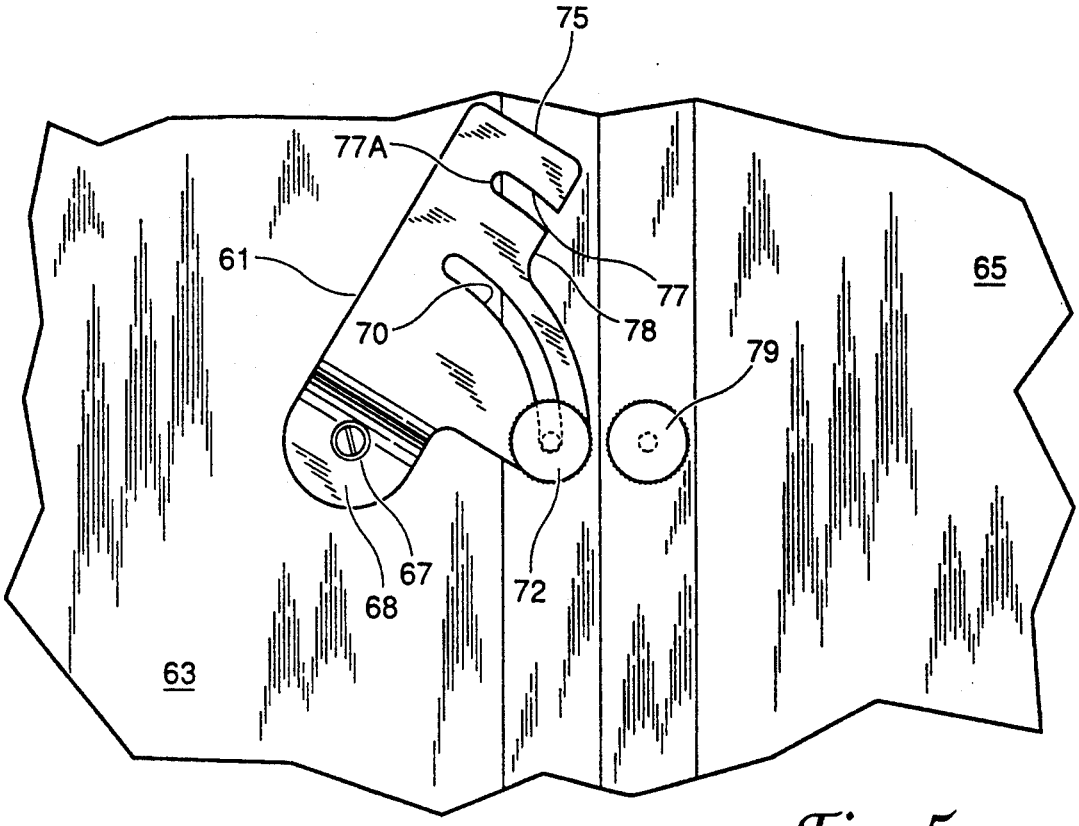
FIG. 5 is an enlarged bottom elevational view of another embodiment of the present invention.

In a further embodiment of the invention, shown in FIG. 5, a bracket 61 is provided which differs from previous bracket 18 in the orientation of the second slot at the connection end of the bracket. The bracket 61, which provides interconnection for table tops 63 and 65, is pivotably mounted to table top 63 by screw 67 at pivot end 68. A first slot 70 is defined in the bracket providing an arcuate opening to engage a fastener 72 adjustably threaded into table top 63. As thus far described, bracket 61 is substantially identical to previous bracket 18. However, unlike the prior embodiment, the connection end 75 of bracket 61 includes a second slot 77 which itself circumscribes an arcuate opening running substantially parallel to first slot 70. The second slot 77 opens at the side edge 78 of the bracket 61.

In use, as the bracket 61 is pivoted about screw 67, second slot 77 swings through an arc to engage thumbscrew 79 threaded into second table top 65. Preferably, the bracket 61 is rotated until thumbscrew 79 contacts the end 77A of slot 77. One advantage of this configuration of bracket 61, and particularly second slot 77, is that the two table tops 63 and 65 can be moved into abutting position without first having the bracket 61 moved to its extended position. In contrast, the pivoting bracket assembly 15 illustrated in FIG. 1 must be moved from the retracted position 11B to the extended position 11A prior to juxtaposition of the table tops. A further advantage is that disengagement requires pivoting the bracket 61, rather than simply linear movement of the bracket relative to the table top as with prior apparatus.

Figure 7:
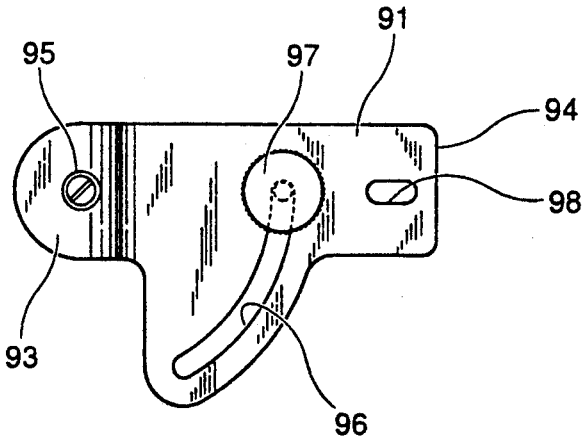
FIG. 7 is an enlarged bottom elevational view of the bracket on the table leaf shown in FIG. 6.
Figure 6:
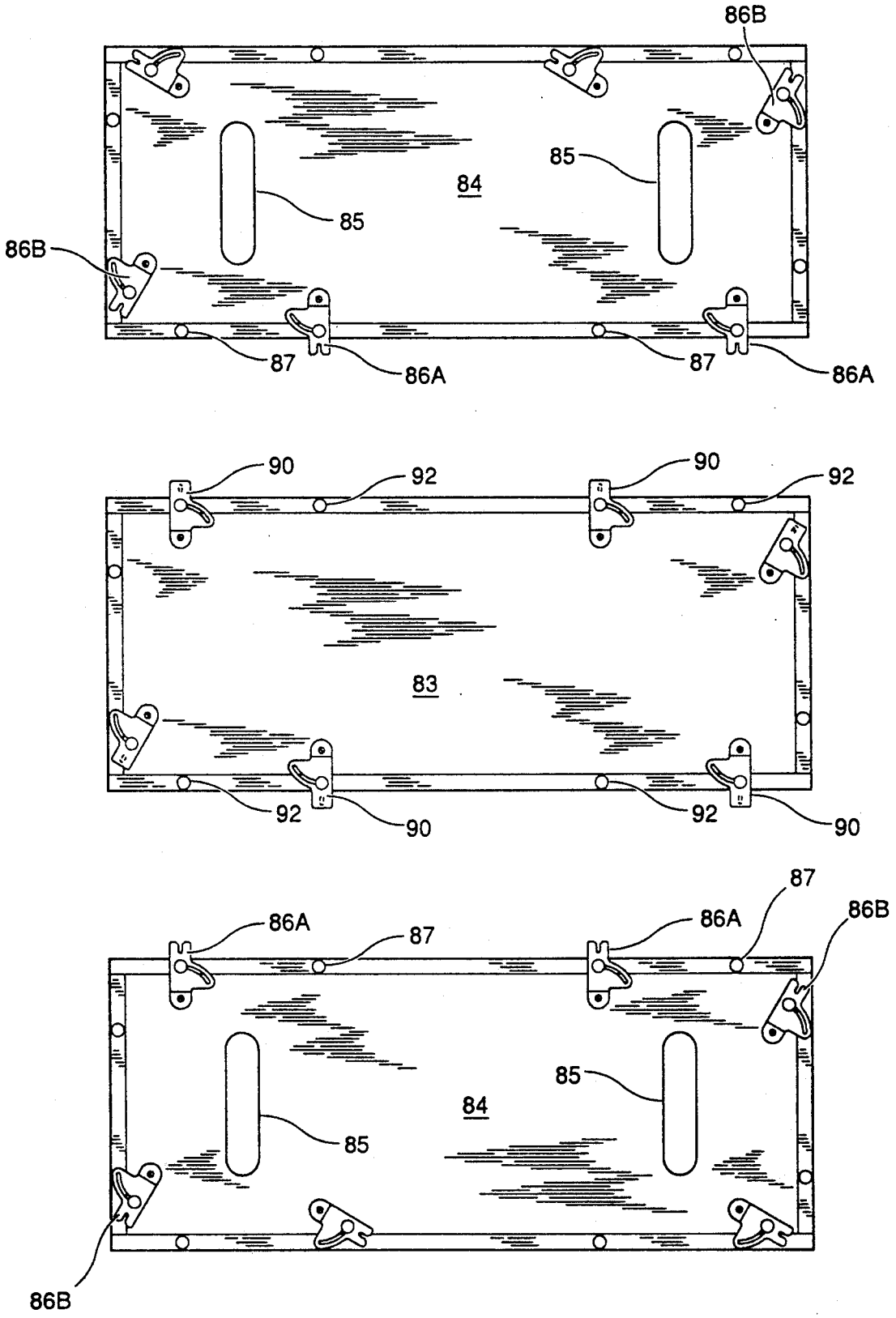
FIG. 6 is a bottom elevational view showing a table leaf positioned between two table tops for interconnection thereto and illustrating an alternative embodiment of the bracket mounted on the table leaf.

Referring now to FIGS. 6 and 7, yet another embodiment of the invention is depicted in which a closed-ended bracket 90 is provided for engaging a table leaf, such as leaf 83, between two free-standing table tops, such as table tops 84 having vertical legs 85. The table tops 84 are substantially identical to table tops 11 and 12 previously described, each table including an arrangement of bracket assemblies in extended (86A) and retracted (86B) positions, all constructed in accordance with the bracket assembly 15, as well as mounting means thumbscrew fasteners 87, constructed in accordance with thumbscrew fasteners 17. Alternatively, the bracket assemblies 86 may be constructed in accordance with any one of the other embodiments of the invention.

The table leaf 83 includes similarly arranged closed-ended bracket assemblies 90 and mounting means thumbscrew fasteners 92 in complementary orientation to the bracket assemblies and fasteners on the two table tops 84. As shown in detail in FIG. 7, the bracket assembly 90 includes a bracket 91 having a pivot end 93 and connection end 94. A first fastener, such as screw 95, provides means for mounting the bracket 91 to the table leaf 83. An arcuate slot 96 is defined between the two ends of the bracket for receiving a second fastener 97 therethrough, which second fastener is itself connected to the table leaf 83.

As thus far described, the bracket 91 is substantially similar to bracket 18 of FIGS. 1-3. In a modification from the previous embodiments, the bracket 91 includes a second slot 98 defined at the connection end 94 of the bracket. As seen in FIGS. 6 and 7, the second slot 98 is a closed-ended slot. The second slot 98 of bracket 91 is intended for engagement with thumbscrews 87 in either table top 84. Since the second slot 98 is closed, it is apparent that the thumbscrews 87 must first be removed from the table tops 84 prior to bracket 91 being moved to its extended position spanning between the table leaf and the table tops. The extended bracket assemblies 86A mounted to table tops 84 will support the table leaf 83 between the table tops until the brackets 91 are moved into their operative positions. At that point, the thumbscrews 87 can be placed through slots 98 and threaded into the underside of the table tops 84 to clamp the bracket 91 to the table tops.

The closed end of the second slot 98 is provided as a safety feature to prevent disengagement between the thumbscrew 87 and bracket second slot 98. Since the leaf 83 is only supported by the interconnection brackets, any such disengagement could cause the table leaf to fall between the table tops. It is therefore important that the continuity of this engagement be preserved, a requirement that is met by the closed-ended bracket 91 of this latter embodiment.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. An apparatus for the interconnection of two or more table tops, a first such table top having an underside bounded by a plurality of edges, and a second such table also having an underside bounded by a plurality of edges, said apparatus comprising:

a brakcet having a pivot end and a connection end, and defining a first slot between said pivot end and said connection end, said first slot having a first end and a second end, said bracket further defining a second slot at said connection end of said bracket;

mounting means for mounting said bracket to the underside of a first table top, said mounting means including;

first fastener means for pivotably fastening said pivot end of said bracket to the underside of the first table top for pivoting said bracket in a plane parallel to the underside of the table top; and second fastener means engagable to the underside of the first table top and extending through said first slot for fastening said bracket to the table top at said first slot, whereby when said bracket is mounted to the first table top said bracket is pivotable about said first fastener means between a first position in which said second fastener means is located at said first end of said first slot and said bracket is oriented with said second slot extending beyond an edge of the first table, and a second position in which said second fastener means is located at said second end of said first slot and said bracket is positioned substantially completely under the first table top; and third fastening means for clamping said bracket at said second slot to the underside of a second table top when said bracket is in said first position and one edge of each of the table tops is abutting.

2. The apparatus of claim 1 wherein said first slot forms a first arcuate opening between said first end and said second end.

3. The apparatus of claim 2 wherein said second slot forms a second arcuate opening substantially parallel to said first arcuate opening of said first slot.

4. The apparatus of claim 1 wherein;

said second slot is open ended at said connection end; and said third fastener means includes a threaded fastener for engaging the table top, whereby said third fastener means can be slidably engaged into said second slot at said connection end.

5. The apparatus of claim 1, wherein said second slot is elongated along an axis passing through said first fastener means and said second fastener means when said second fastener means is engaged to the underside of the first table top.

6. The apparatus of claim 5, wherein said second slot has closed first and second ends along said axis.

7. The apparatus of claim 5, wherein said second slot has a first closed end and a second open end along said axis.

8. A table assembly comprising:

a pair of self-supported table tops each having an underside bounded by a plurality of edges;

a table leaf having an underside bounded by a plurality of edges; and means for supporting said table leaf between said pair of self-supported table tops with the edges of said table leaf abutting corresponding edges of each of said pair of self-supported table tops, said means including at each abutting edge;

a bracket having a pivot end and a connection end, and defining a first slot between said pivot end and said connection end, said first slot having a first end and a second end, said bracket further defining a second slot at said connection end of said bracket;

mounting means for mounting said bracket to the underside of one of said table leaf or said self-supported table top, said mounting means including;

first fastener means for pivotably fastening said pivot end of said bracket to said underside for pivoting said bracket in a plane parallel to said underside; and second fastener means engagable to said underside and extending through said first slot for fastening said bracket to said underside at said first slot, whereby when said bracket is mounted to said one of said table leaf or said self-supported table top said bracket is pivotable about said first fastener means between a first position in which said second fastener means is located at said first end of said first slot and said bracket is oriented with said second slot extending beyond said abutting edge, and a second position in which said second fastener means is located at said second end of said first slot and said bracket is positioned substantially completely under said one of the table leaf or the self-supported table top; and third fastener means for clamping said bracket at said second slot to the underside of the other of said table leaf or said self-supported table top when said bracket is in said first position and one edge of each of said table leaf and said self-supported table top is abutting.

9. The apparatus of claim 8 wherein said first slot forms a first arcuate opening between said first end and said second end.

10. The apparatus of claim 9 wherein said second slot forms a second arcuate opening substantially parallel to said first arcuate opening of said first slot.

11. The apparatus of claim 8 wherein;

said second slot is open ended at said connection end; and said third fastener means includes a threaded fastener for engaging said other of said table leaf or said self-supported table top, whereby said third fastener means can be slidably engaged into said second slot at said connection end.

12. The apparatus of claim 8, wherein said second slot is elongated along an axis passing through said first fastener means and said second fastener means when said said said second fastener means is engaged to the underside of the first table top.

13. The apparatus of claim 12, wherein said second slot has first and second closed ends along said axis.

14. The apparatus of claim 12, wherein said second slot has a first closed end and a second open end along said axis.

15. A table assembly comprising:

a first table top having an underside bounded by a plurality of edges;

a second table top having an underside bounded by a plurality of edges;

means for interengaging said first table top and said second table top with corresponding ones of said edges in abutting relation, said means including;

a bracket having a pivot end and a connection end, wherein said bracket defines an opening in said pivot end and a first slot between said pivot end and said connection end, said first slot having a first end and a second end, said bracket further defining a second slot at said connection end of said bracket;

means for mounting said bracket to the underside of the first table top, said mounting means including;

first means for pivotably fastening said pivot end of said bracket to the underside of the first table top for pivoting said bracket in a plane parallel to the underside of the table top; and second fastener means engagable to the underside of the first table top and extending through said first slot for fastening said bracket to said first table top at said first slot, whereby when said bracket is mounted to said first table top said bracket is pivotable about said first fastener means between a first position in which said second fastener means is located at said first end of said first slot and said bracket is oriented with said second slot extending beyond the abutting edge of said first table, and a second position in which said second fastener means is located at said second end of said first slot and said bracket is positioned substantially completely under said first table top; and third fastening means for clamping said bracket at said second slot to the underside of said second table top when said bracket is in said first position and said table tops are in abutting relation.

16. The apparatus of claim 15, wherein said first slot forms a first arcuate opening between said first end and said second end.

17. The apparatus of claim 15, wherein:

said second slot is open ended at said connection end; and said third fastener means is a threaded fastener for engaging the underside of said second table top, whereby said third fastener means can be slidably engaged into said second slot at said connection end.

18. The apparatus of claim 15, wherein said second slot is elongated along an axis passing through said first fastener means and said second fastener means when said second fastener means is engaged to the underside of the first table top.

19. The apparatus of claim 15, wherein said second slot has a first closed end and a second open end along said axis.

* * * * *